US006341424B1

(12) United States Patent
Kenny et al.

(10) Patent No.: US 6,341,424 B1
(45) Date of Patent: Jan. 29, 2002

(54) TRAINING SCISSORS

(76) Inventors: Robert Kenny; Dawn Kenny, both of 196 6th St., Hicksville, NY (US) 11801

( * ) Notice: Subject to any disclaimer, the term of this patent is extended or adjusted under 35 U.S.C. 154(b) by 0 days.

(21) Appl. No.: 09/754,389

(22) Filed: Dec. 28, 2000

Related U.S. Application Data

(63) Continuation-in-part of application No. 09/322,343, filed on May 28, 1999.

(51) Int. Cl.[7] ..... B26B 13/14
(52) U.S. Cl. ..... 30/232; 30/341
(58) Field of Search ..... 30/232, 260, 341, 30/233, 291

(56) References Cited

U.S. PATENT DOCUMENTS

| | | | | | |
|---|---|---|---|---|---|
| 3,295,203 | A | * | 1/1967 | Thompson | 30/232 |
| 3,374,541 | A | * | 3/1968 | Earnest et al. | 30/232 |
| 3,553,819 | A | * | 1/1971 | Johnson et al. | 30/232 X |
| 5,778,540 | A | * | 7/1998 | Huang | 30/232 |

* cited by examiner

*Primary Examiner*—Douglas D. Watts
(74) *Attorney, Agent, or Firm*—Goldstein Law Offices, P.C

(57) ABSTRACT

A pair of protective scissors, for use by a child, including a pair of elongated members pivotally coupled together by a pivot pin. A pair of cover members are secured to finger apertures of the elongated members. The cover members prevent the child from inserting his or her fingers entirely through the apertures, and thus train the child how to properly hold the scissors.

5 Claims, 1 Drawing Sheet

TRAINING SCISSORS

CROSS REFERENCES AND RELATED SUBJECT MATTER

This application is a continuation-in-part of U.S. patent application Ser. No. 09/322,343—filed in the United States Patent Office on May 28, 1999.

BACKGROUND OF THE INVENTION

The present invention relates to a pair of training scissors and more particularly pertains to scissors which prevent a user from sliding their fingers entirely through handles of the scissors, so as to train a young user how to properly hold and operate the scissors.

Scissors are tools that are used to cut all types of objects, most typically for use in cutting paper products. Children, at an early age, are taught safety rules when using scissors, typically as to how they are supposed to carry the scissors and that they should never run while carrying the scissors.

Standard scissors are provided with pivoting handles that have holes therethrough for receiving fingers of the user. However, these standard scissors do not regulate how far the fingers can extend through these holes. Any adult will note that to effectively use scissors, you cannot extend your fingers fully through the holes, or you would not have sufficient leverage to operate the scissors. However, when young children attempt to use the scissors, they often have difficulty in preventing their fingers from extending fully through the holes, and thus have a hard time operating the scissors. What is needed is a way of preventing the fingers from extending too far through the finger holes of the scissors so as to train the young user how to properly operate the scissors.

The present invention attempts to solve the above mentioned problem by providing a device that incorporates covers on the finger hole to prevent the user from pushing their fingers completely through the finger holes thereby decreasing the possibility of an accident.

The use of cutting tools is known in the prior art. More specifically, cutting tools heretofore devised and utilized for the purpose of allowing objects to be cut are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,987,542 to Visco and U.S. Pat. No. 4,250,619 to Buerkert disclose various scissors handle arrangements. U.S. Pat. No. Des. 344,225 to Hendon and U.S. Pat. No. Des. 385,174 to Kawai disclose various ornamental designs for a pair of scissors.

While these devices fulfill their respective, particular objective and requirements, the aforementioned patents do not describe a pair of protective scissors for preventing a user from sliding their fingers entirely through handles of the scissors.

In this respect, the pair of protective scissors according to the present invention substantially departs from the conventional concepts and designs of the prior art, and in doing so provides an apparatus primarily developed for the purpose of preventing a user from sliding their fingers entirely through handles of the scissors.

Therefore, it can be appreciated that there exists a continuing need for new and improved pair of protective scissors which can be used for preventing a user from sliding their fingers entirely through handles of the scissors. In this regard, the present invention substantially fulfills this need.

SUMMARY OF THE INVENTION

In the view of the foregoing disadvantages inherent in the known types of cutting tools now present in the prior art, the present invention provides an improved pair of protective scissors. As such, the general purpose of the present invention, which will be described subsequently in greater detail, is to provide a new and improved pair of protective scissors and method which has all the advantages of the prior art and none of the disadvantages.

To attain this, the present invention essentially comprises a pair of elongated members pivotally coupled together by a pivot pin. Each of the elongated members have a cutting blade at one end thereof and a handle member at a second end thereof. Each handle member has a finger aperture therethrough for receiving a finger therethrough. A pair of cover members are secured to the finger apertures of the elongated members. The cover members each have an open upper end and a closed lower end. The open upper end are secured to the finger apertures for receiving fingers therein. The fingers received within the cover members are precluded from extending completely through the finger apertures by the closed lower ends of the cover members.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved pair of protective scissors which has all the advantages of the prior art cutting tools and none of the disadvantages.

It is another object of the present invention to provide a new and improved pair of protective scissors which may be easily and efficiently manufactured and marketed.

It is a further object of the present invention to provide a new and improved pair of protective scissors which is of durable and reliable construction.

An even further object of the present invention is to provide a new and improved pair of protective scissors which is susceptible of a low cost of manufacture with regard to both materials and labor, and which accordingly is then susceptible of low prices of sale to the consuming public, thereby making such a pair of protective scissors economically available to the buying public.

Even still another object of the present invention is to provide a new and improved pair of protective scissors for preventing a user from sliding their fingers entirely through handles of the scissors, and thus which are particularly effective in training a young user how to properly hold the scissors while allowing them to successfully cut using the scissors.

Lastly, it is an object of the present invention to provide a new and improved pair of protective scissors including a pair of elongated members pivotally coupled together by a pivot pin. A pair of cover members are secured to finger apertures of the elongated members.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
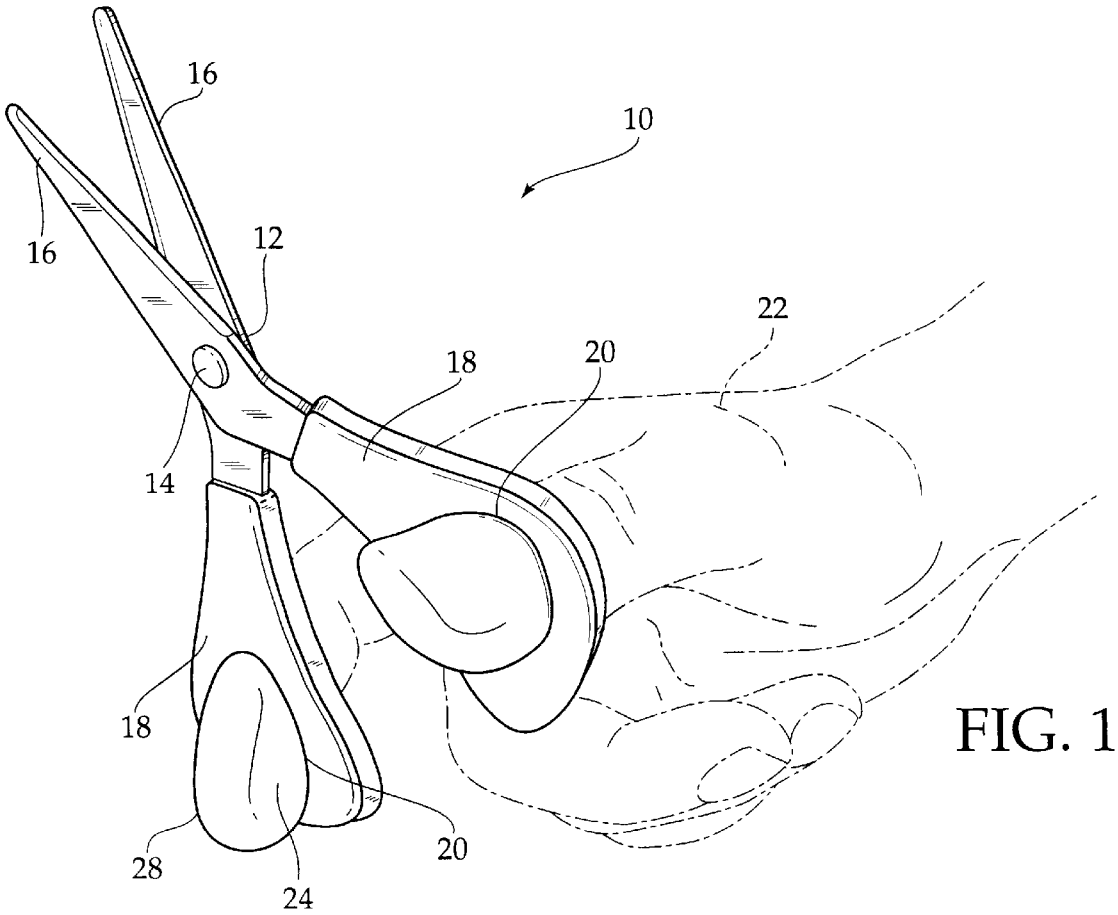
FIG. 1 is a perspective view of the preferred embodiment of the pair of protective scissors constructed in accordance with the principles of the present invention illustrated in use.
Figure 2:
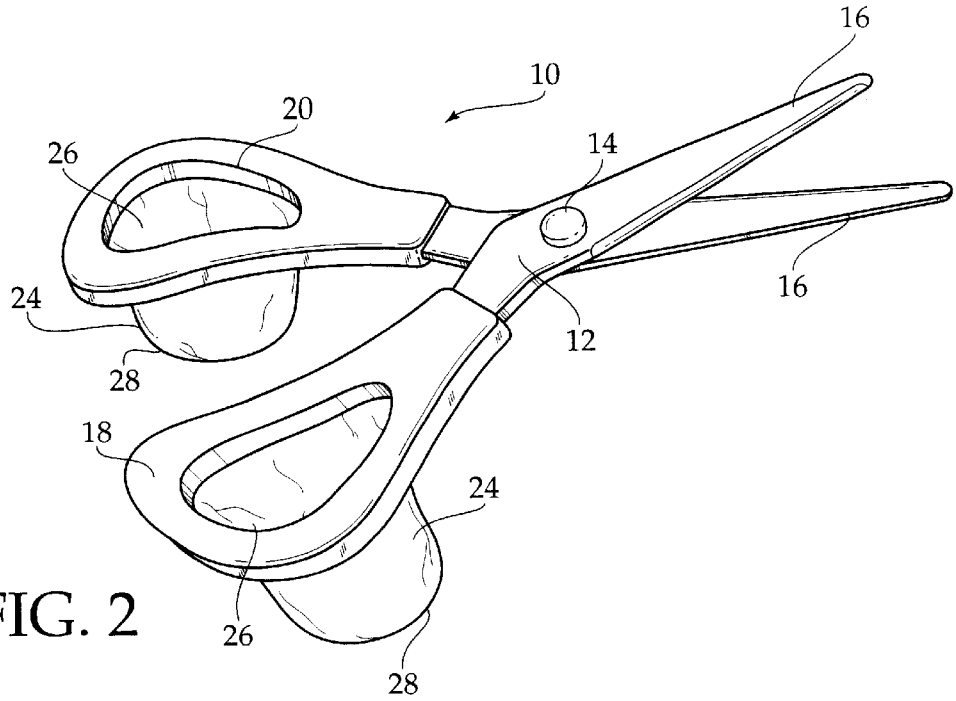
FIG. 2 is a perspective view of the present invention as taken from FIG. 1 illustrated not is use.

With reference now to the drawings, and in particular, to FIGS. 1 and 2 thereof, the preferred embodiment of the new and improved pair of protective scissors embodying the principles and concepts of the present invention and generally designated by the reference number 10 will be described.

Specifically, it will be noted in the various Figures that the device relates to a pair of protective scissors for preventing a user from sliding their fingers entirely through handles of the scissors. In its broadest context, the device consists of a pair of elongated members and a pair of cover members. Such components fare individually configured and correlated with respect to each other so as to attain the desired objective.

The pair of elongated members 12 are pivotally coupled together by a pivot pin 14. Each of the elongated members 12 have a cutting blade 16 at one end thereof and a handle member 18 at a second end thereof. Each handle member 18 has a finger aperture 20 therethrough for receiving a finger 22 therethrough.

The pair of cover members 24 are secured to the finger apertures 20 of the elongated members 12. The cover members 24 have an open upper end 26 and a closed lower end 28. The cover members 24 form a cup-like shape between the open upper end 26 and closed lower end 28. The open upper end 26 are secured to the finger apertures 20 for receiving fingers 22 therein. The fingers 22 received within the cover members 24 are precluded from extending completely through the finger apertures 20 by the closed lower ends 28 of the cover members 24. The cover members 24 are preferably constructed from a cloth material that will not irritate the skin of the user.

In use, the present invention can be used in the normal cutting of objects, such as paper, but the closed lower end 28 of the cover members 24 will stop the fingertips and thus prevent the fingers 22 from extending too far through the finger apertures 20 thereby allowing a novice user to effectively cut using the scissors, while training the user properly hold the scissors with their fingers located in their proper positions.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A pair of protective scissors for preventing a user from sliding their fingers entirely through handles of the scissors comprising, in combination:

a pair of elongated members pivotally coupled together by a pivot pin, each of the elongated members having a cutting blade at one end thereof and a handle member at a second end thereof, each handle member having a finger aperture therethrough for receiving a finger therethrough;

a pair of cover members secured to the finger apertures of the elongated members, the cover members having an open upper end and a closed lower end, the cover member forming a cup shape between the open upper end and closed lower end, the open upper end being secured to the finger apertures for receiving fingers therein as they extend through the finger apertures from an opposite side thereof, the fingers received within the cover members being stopped from extending further through the finger apertures by the closed lower ends of the cover members.

2. A pair of protective scissors for preventing a user from sliding their fingers entirely through handles of the scissors comprising, in combination:

a pair of elongated scissors members pivotally coupled together by a pivot pin, each scissors member having a handle having an aperture;

a pair of cover members secured to finger apertures of the elongated members, the cover member having an open upper end in communication with one of the apertures and a closed lower end, the cover members each allowing one of the fingers to extend through its associated finger aperture from an opposite side of said finger aperture, but preventing the entire finger from extending through said aperture.

3. The pair of protective scissors as set forth in claim 2 wherein the cover members have an open upper end and a closed lower end, the open upper-end being secured to the finger apertures for receiving fingers therein.

4. The pair of protective scissors as set forth in claim 3 wherein the fingers received within the cover members are precluded from extending completely through the finger apertures by the closed lower ends of the cover members.

5. A scissors training method, for allowing a child having fingers and fingertips to use a pair of scissors and teaching the child how to properly hold the scissors, comprising the steps of:

providing a pair of scissors having a pair of handles, each handle having an aperture, the scissors also having a pair of cover members which each have an open upper end aligned with one of the apertures and a closed lower end, each of the cover members forming a cup aligned with and attached to its associated aperture;

inserting the fingertips of the child through the apertures; and stopping the child from inserting his entire fingers through the apertures by stopping the fingertips thereof by the closed lower end.

* * * * *